US007073787B2

(12) United States Patent
Kinsley et al.

(10) Patent No.: US 7,073,787 B2
(45) Date of Patent: Jul. 11, 2006

(54) MEDIA TRAY DAMPER

(75) Inventors: Tod A. Kinsley, Tigard, OR (US); Jan W. Boldt, Washougal, WA (US); Michael K. Bowen, Vancouver, WA (US); Robert G. Fritz, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 88 days.

(21) Appl. No.: 10/736,245

(22) Filed: Dec. 15, 2003

(65) Prior Publication Data

US 2005/0127593 A1 Jun. 16, 2005

(51) Int. Cl.
*B65H 1/00* (2006.01)
*B65H 31/04* (2006.01)

(52) U.S. Cl. ..... 271/162; 271/213; 211/131.2; 211/126.6; 70/38; 70/95; 70/118

(58) Field of Classification Search ..... 271/347, 271/162, 213; 70/38, 95, 118, 25; 211/131.2, 211/126.6
See application file for complete search history.

(56) References Cited

U.S. PATENT DOCUMENTS

| | | | | |
|---|---|---|---|---|
| 3,409,339 | A * | 11/1968 | Rhoda et al. | 312/8.4 |
| 4,457,497 | A * | 7/1984 | Ojima | 267/134 |
| 4,768,630 | A | 9/1988 | Aubry et al. | |
| 5,193,228 | A * | 3/1993 | Murasawa et al. | 4/236 |
| 5,464,205 | A * | 11/1995 | Bang | 271/213 |
| 5,626,225 | A * | 5/1997 | Joyce, Jr. | 206/308.1 |
| 6,026,776 | A * | 2/2000 | Winberg | 123/192.1 |
| 6,042,103 | A * | 3/2000 | Yraceburu et al. | 271/118 |
| 6,129,348 | A | 10/2000 | Park | |
| 6,260,839 | B1 | 7/2001 | Araki et al. | |
| 6,357,740 | B1 | 3/2002 | Inoue et al. | |
| 6,382,617 | B1 * | 5/2002 | Yen et al. | 271/3.14 |
| 6,457,707 | B1 | 10/2002 | Hendrix et al. | |
| 6,595,514 | B1 * | 7/2003 | Takahashi | 271/162 |
| 6,848,685 | B1 * | 2/2005 | Katsuyama | 271/162 |
| 2003/0044594 | A1 * | 3/2003 | Kobayashi et al. | 428/308.4 |

* cited by examiner

*Primary Examiner*—Gene O. Crawford
*Assistant Examiner*—Leslie A. Nicholson, III

(57) ABSTRACT

A media handling device comprises a frame, a media tray, and a damper. The media tray is mountable to the frame for pivotal movement between a first position and a second position relative to the frame. The damper is disposed on the frame and configured for maintaining frictional engagement with the media tray.

6 Claims, 4 Drawing Sheets

MEDIA TRAY DAMPER

BACKGROUND

Desktop printers and copiers commonly include a media tray used for receiving output or for providing media as part of a media input path. The media tray is typically rotatably mounted to the printer or copier via a conventional hinge so that the media tray is movable between an open position and a closed position. In the open position, the tray is generally horizontal to supply media or receive media. The media tray also can be pivoted upward to a closed position in which the media tray is generally perpendicular to the output path or input media path. The media tray is commonly placed in the closed position when the printer is not in use to save space on the desktop on which the printer or copier resides. Providing dampening to the media tray has been problematic in the past.

DETAILED DESCRIPTION

In the following Detailed Description, reference is made to the accompanying drawings, which form a part hereof, and in which is shown by way of illustration specific embodiments in which the invention may be practiced. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims. All such variations are within the scope of the present invention.

Figure 1:
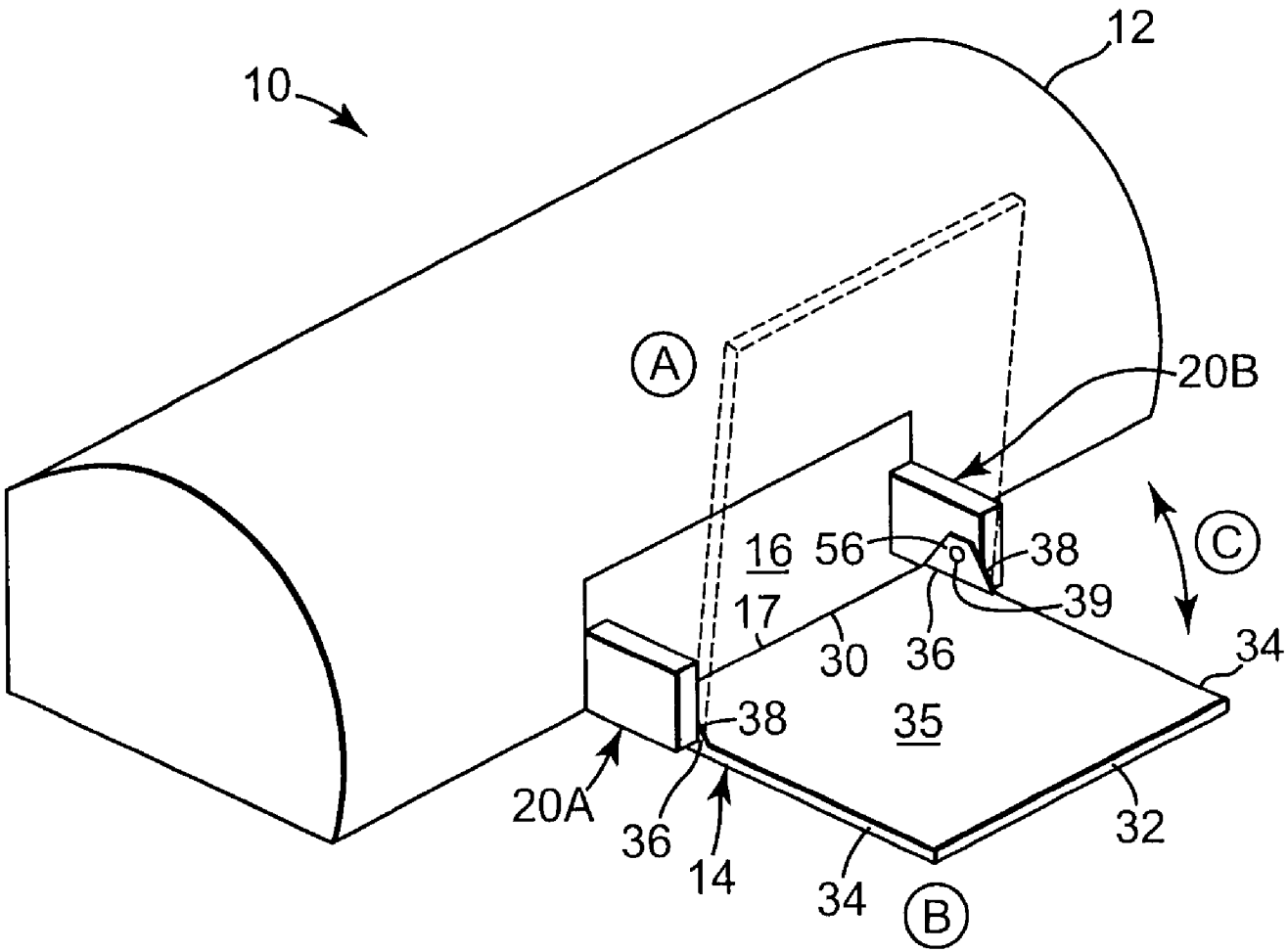
FIG. 1 is an isometric view of a media handling device with a media tray, according to an embodiment of the present invention.

One exemplary embodiment of the present invention is shown generally in FIG. 1 as media handling device 10. Media handling device 10 comprises frame 12 and media tray 14. As shown by directional arrow C, media tray 14 is movable between a first closed position A (shown in phantom) and a second open position B. Media handling device 10 comprises any one of various devices that handle media, such as a printer, a photocopier, a facsimile machine, a multifunction printer, etc. Media tray 14 holds various forms of media such as paper, transparencies, photos, etc.

As shown in FIG. 1, device frame 12 further comprises inner tray 16 and first pivot housing 20A and second pivot housing 20B. Media tray 14 comprises inner end 30, outer end 32, side edges 34, body 35, and inner corners 36. Each inner corner 36 includes securing portion 38 with hole 39.

As shown in FIG. 1, securing portion 38 of media tray 14 mounts onto device frame 12 at pivot housing 20B via hole 39 and protrusion 56 disposed on device frame 12. Inner end 30 of media tray 14 abuts or is adjacent edge 17 of inner tray 16 with media tray 14 extending outwardly from inner tray 16 in a generally horizontal orientation. Body 35 of media tray 14 and inner tray 16 together comprise at least a portion of a media path for media handling device 10. Upon moving media tray 14 from open position B to closed position A, inner end 30 of media tray 14 separates from edge 17 of inner tray 16 and body 35 of media tray 14 is moved to a generally perpendicular position relative to inner tray 16. The precise orientation of media tray 14 in the open and closed positions may vary. In some embodiments, media tray 14 may comprise a media input tray and in other embodiments media tray 14 may comprise a media output tray. Additional trays may be included with the embodiment shown in FIG. 1, but are not shown for clarity.

Figure 2:
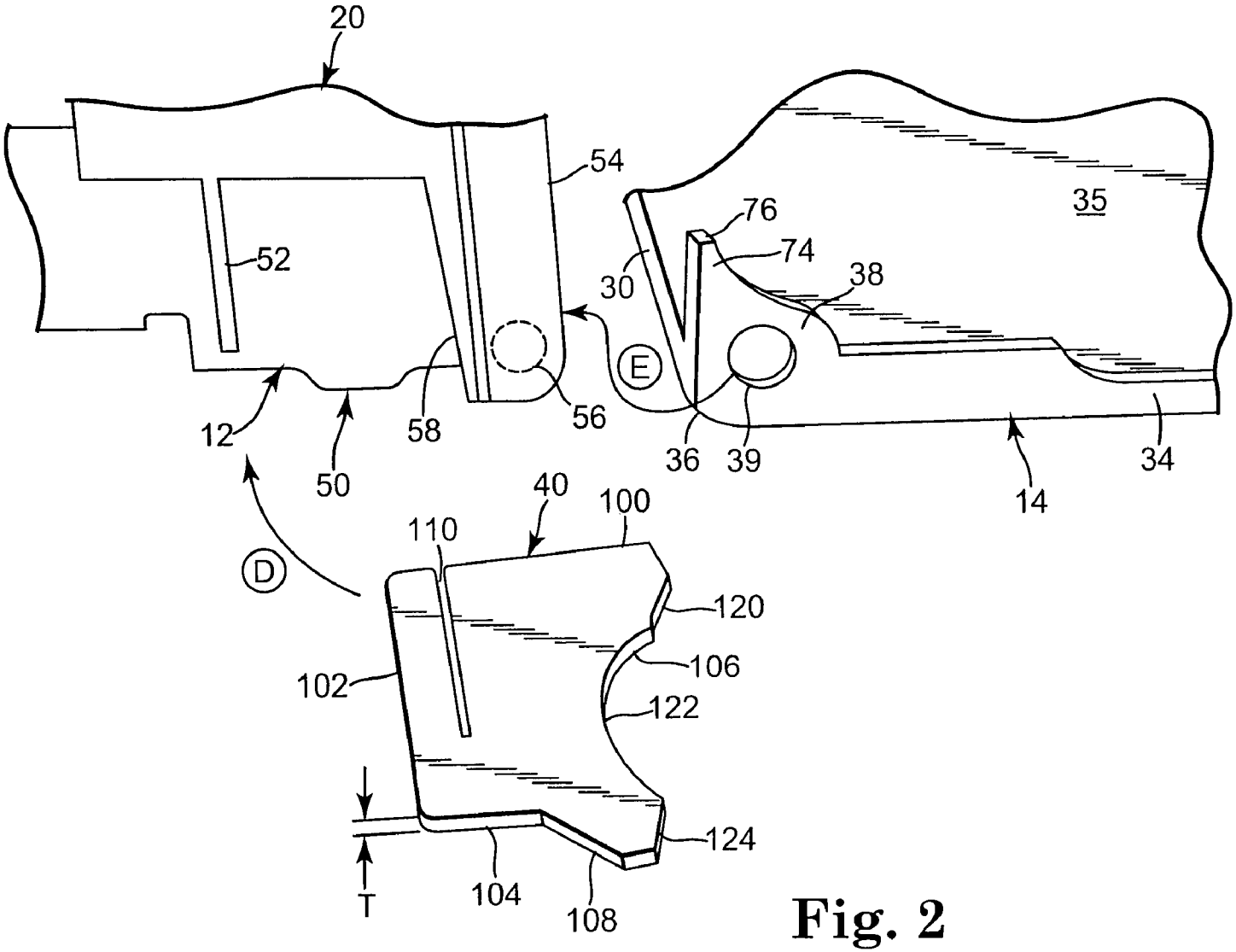
FIG. 2 is combination of plan and isometric views of components of a media tray, according to an embodiment of the present invention.

FIG. 2 illustrates components of device frame 12 and media tray 14 prior to pivotally mounting media tray 14 on device frame 12. In particular, FIG. 2 illustrates aspects of device frame 12 and media tray 14 that are visible when pivot housings 20A, 20B are removed. Removal of pivot housings 20A, 20B reveals lower portion 50 of device frame 12, damper 40, and securing portion 38 of media tray 14.

For illustrative purposes, FIG. 2 only shows components of only one side of device frame 12 and one side of media tray 14 when pivot housing 20A is removed. However, it is understood that second pivot housing 20B (FIG. 1) on opposite side of device frame 12 likewise houses identical components as those shown in FIG. 2, except oriented for the opposite side of device frame 12.

As shown in FIG. 2, lower frame portion 50 comprises elongate protrusion 52, vertical arm 54, cylindrical pivot protrusion 56, and edge 58. Cylindrical pivot protrusion 56 is shown in phantom to illustrate its inwardly directed orientation. Pivot protrusion 56 is sized and shaped to slidably receive and mate with hole 39 of securing portion 38 of media tray 14, thereby permitting pivotal movement of media tray 14 relative to device frame 12. Directional arrow E illustrates maneuvering of securing portion 38 of media tray 14 for pivotal mounting on pivot protrusion 56 of lower frame portion 50 of device frame 12.

As further shown in FIG. 2, media tray 14 comprises those elements previously described in association with FIG. 1 and further comprises finger 74 with tip 76 that extends from securing portion 38. Finger tip 76 is made from a molded hard plastic, such as a high impact polystyrene (HIPS), according to an example embodiment. In some embodiments, finger 74 and the remainder of media tray 14 are made of the same material as tip 76. Other suitable materials may be alternatively employed.

As also shown in FIG. 2, damper 40 comprises top portion 100, back portion 102, bottom portion 104, and front contact portion 106, as well as lower arm 108. Damper 40 also comprises slot 110. Front contact portion 106 includes first contact surface 120, second curved contact surface 122, and third contact surface 124.

Damper 40 may be made from an elastomer material such as a rubber material, flexible plastic, or thermoplastic elastomer, such as a SANTROPRENE® brand thermoplastic material. In one aspect, damper 40 has a hardness in the range of about 50–100 Shore A hardness. However, damper 40 is not strictly limited to this hardness range since other parameters such as the shape, relative smoothness, and size of contact portion 106 of damper 40 in relationship to the shape, relative smoothness, hardness, and size of finger tip 76 affect the sliding frictional engagement between finger tip 76 and damper 40. Accordingly, as the relative hardness of damper is changed, other parameters can be adjusted to insure the desired frictional sliding engagement between finger tip 76 and damper 40. Accordingly, damper 40 is non-fluidic, solid member (i.e. not fluid-filled) having a hardness and surface characteristics adapted to enable sliding frictional engagement against finger tip 76 of media tray 14.

In some embodiments, damper 40 is constructed so that only contact portion 106 is made of a material that has the requisite relative hardness, shape and surface characteristics to enable the desired sliding frictional engagement against finger tip 76, with a remaining portion of damper 40 being constructed of different materials.

To deploy damper 40 on device frame 12, damper 40 is advanced onto device frame 12 (shown by directional arrow D) by aligning slot 110 of damper 40 with elongate protrusion 52 of lower device frame 50 and slidably advancing slot 110 onto elongate protrusion 52. Frictional engagement between slot 110 and elongate protrusion secures damper 40 onto lower device frame 50, as will be shown in FIGS. 3–5. Securing portion 38 of media tray 14 is maneuvered adjacent to pivot protrusion 56 until securing hole 39 is slidably mounted onto pivot protrusion 56 (shown by directional arrow E), thereby enabling pivoting of media tray 14 relative to device frame 12.

Elongate protrusion 52 of lower device frame 50 and slot 110 of damper 40 may be replaced in some embodiments with an alternative fastening mechanism of reciprocating parts (e.g., pins, holes, bolts, adhesives, etc) adapted to secure damper 40 to lower device frame 50. Accordingly, other fastening mechanisms and mating arrangements can be used to mount damper 40 onto lower device frame 50 of device frame 12.

Figure 4:
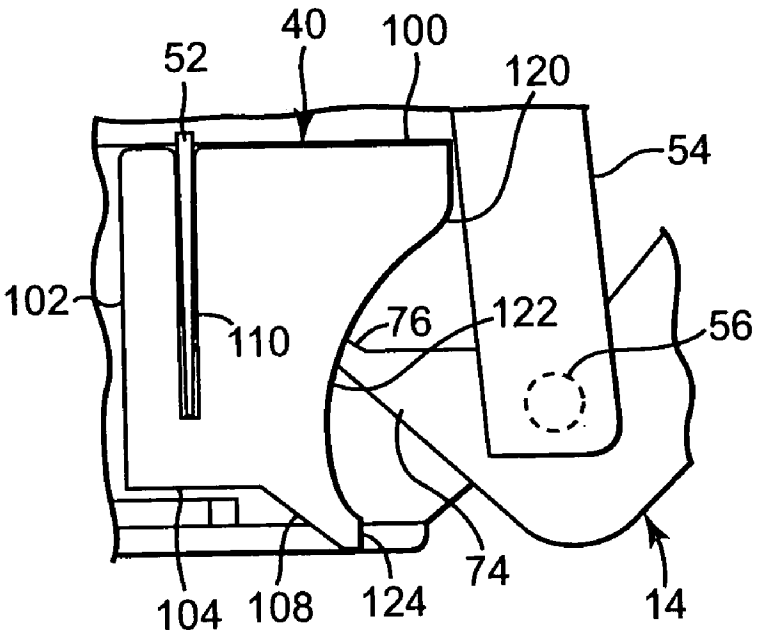
FIG. 4 is a side view schematically illustrating a media tray in an intermediate position, according to an embodiment of the present invention.
Figure 3:
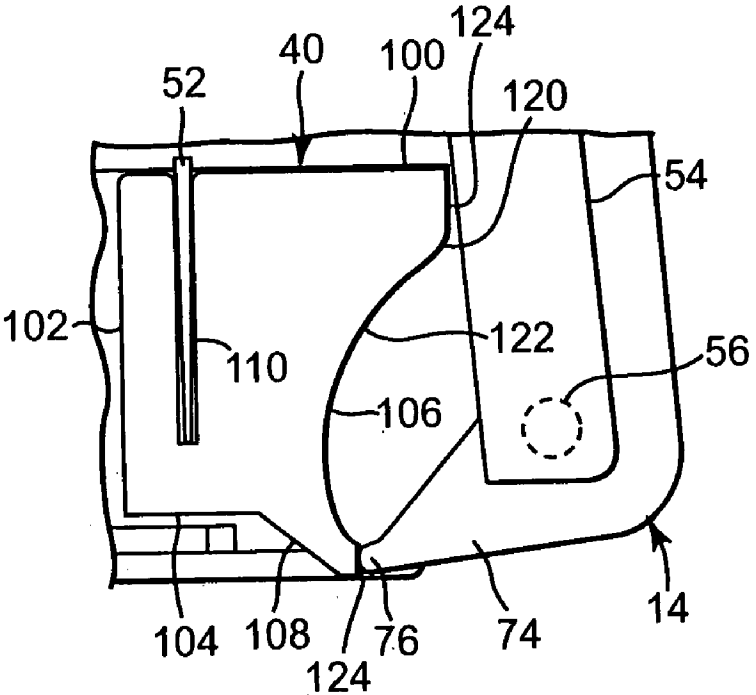
FIG. 3 is a side view schematically illustrating a media tray in a closed position, according to an embodiment of the present invention.
Figure 5:
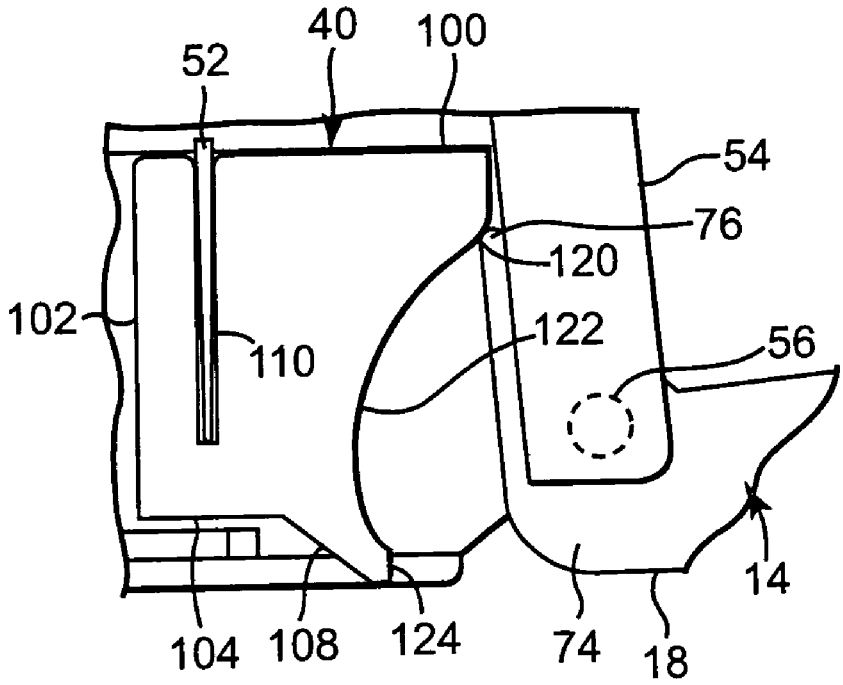
FIG. 5 is a side view schematically illustrating a media tray in an open position, according to an embodiment of the present invention.

FIGS. 3–5 are side views of media handling device 10 with pivot housing 20A disassembled to reveal damper 40 as installed on lower frame portion 50 of device frame 12 and securing portion 38 of media tray 14 pivotally mounted to pivot protrusion 56 of device frame 12. In this mounted position, contact portion 106 of damper 40 is in a spaced relationship to pivot protrusion 56 wherein finger 74 has a length sufficient to establish and maintain sliding contact of finger tip 76 against contact portion 106. Moreover, once mounted on lower frame portion 50 of device frame 12, damper 40 extends in substantially the same plane as finger 74 of media tray 14 to insure sliding frictional engagement between finger tip 76 and contact portion 106 of damper 40.

As shown by FIGS. 2–3, damper 40 is non-mechanistic, i.e. has no moving parts. Damper 40 is also independent of (i.e. separate from) the pivoting mechanism (pivot protrusion 56 of device frame 12, hole 39 of media tray 14) that allows media tray 14 to pivot relative to device frame 12. Only finger 74 of media tray 14, which does not cause pivotal movement in media tray 14, in combination with the relative mounted positions of damper 40 interposed between media tray 14 and device frame 12 causes media tray 14 to engage damper 40 on device frame 12.

FIGS. 3–5 show interaction of media tray 14 with damper 40 as media tray 14 is moved from a first closed position (shown in FIG. 3) to a second open position (shown in FIG. 5) with FIG. 4 illustrating sliding pivotal movement of media tray 14 relative to device frame 12 between the open and closed positions.

FIG. 3 shows media tray 14 in its first closed position relative to device frame 12. In this position, finger tip 76 is in stationary contact with third contact surface 124 of damper 40, which maintains media tray 14 in a vertically upright position relative to device frame 12. The shape, size, relative hardness, and surface characteristics of third contact surface 124 of damper 40 in relation to the size, shape, relative hardness, and surface characteristics of tip 76 is sufficient to maintain media tray 14 in this position. In this position, body 35 of media tray 14 extends generally parallel to vertical member 54 of device frame 12 but generally perpendicular to inner tray 16, which forms a paper path.

FIG. 4 shows media tray 14 in its intermediate position as it is being moved to the second open position relative to device frame 12. In this position, finger tip 76 is in sliding contact with, and frictionally engages, second curved surface 122 of contact portion 106 of damper 40. The shape, surface characteristics, relative hardness, and size of contact surface portion 122 relative to the shape, surface characteristics, relative hardness and size of finger tip 76 causes finger tip 76 to frictionally slide upward against second curved surface 122 at a controlled rate. This interaction permits pivotal movement of media tray 14 relative to device frame 12. This pivotal movement is maintained by action of gravitational forces on the apparent weight of media tray 14, which increases as outer end 32 of media tray 14 travels downward. As shown in FIG. 3, the radius of curvature of second contact surface 122 gradually becomes greater (i.e., the curved surface is tighter) as finger tip 76 moves closer to first contact surface 120. This increasing radius of curvature counteracts the increasing apparent force exerted by finger tip 76 as media tray 14 becomes more horizontal due to gravity. This controlled rate of sliding engagement between finger tip 76 and contact portion 106 of damper 40 imparts a controlled motion to media tray 14, i.e. a substantially uniform velocity of the media tray, as it pivots from its first closed position to the second open position. As observed by the user, non-fluidic damper 40 causes media tray 14 to smoothly and slowly drop from its closed position to the open position, instead of quickly slamming downward as would otherwise occur in the absence of damper 40.

To initially move media tray 14 out of its stationary closed position, an operator manually moves outer end 32 of media tray 14 outward and downward, thereby dislodging finger tip 76 from first upper contact portion 120 of damper 40 into second intermediate contact portion 122, at which finger tip 76 can slide relative to contact portion 122 in a controlled manner.

FIG. 5 shows media tray 14 in its second open position relative to device frame 12. In this position, finger tip 76 is in stationary contact with first contact surface 120 of damper 40, which maintains media tray 14 in a horizontal resting position relative to device frame 12. In this position, body 35 of media tray 14 extends generally parallel to inner paper path 16 of device frame 12. The size, shape, relative hardness, and surface characteristics (e.g. roughness) of first contact surface 120 of damper 40 relative to the size, shape, relative hardness, and surface characteristics of finger tip 76 is sufficient to maintain media tray 14 in this position. In addition, the weight of media tray 14 is maintained in this lower horizontal open position by the effect of gravity.

Media tray 14 can readily be moved from its second, open position to the first closed position by manually lifting outer end 32 of media tray 14 upward in a pivoting motion, thereby dislodging finger tip 76 of media tray 14 from first contact surface 120 to cause finger tip 76 to slide along second contact surface 122 until finger tip 76 rests at first contact surface 120. In this maneuver, an upward manual force must be applied at all times until media tray 14 reaches the closed position at which time the interaction of finger tip 76 relative to third contact surface 124 (previously described above) maintain media tray 14 in that position.

Figure 6:
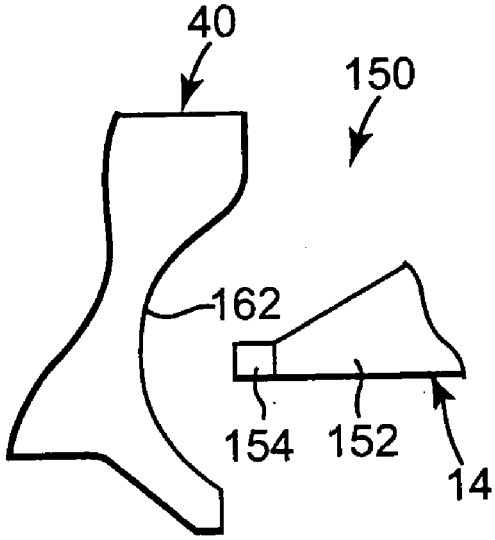
FIG. 6 is a plan view of an alternative media tray and damper, according to an embodiment of the present invention.

Finally, in an alternative aspect of media handling device 10, the type of material comprising each of finger tip 76 of media tray 14 and contact portion 106 of damper 40 are reversed so that contact portion 106 comprises a hard plastic material and finger tip 76 comprises an elastomeric material. As shown in FIG. 6, in this alternative system 150 media tray 14 includes finger 152 with finger tip 154 that comprises the elastomeric material and damper 40 includes contact portion 162 that comprises the hard plastic material. However, in all other respects, finger tip 154 and contact portion 162 operate substantially the same as combination of finger tip 76 of media tray 14 and contact portion 106 of damper 40, as described in association with FIGS. 1–5.

Embodiments of the present invention enable controlled motion during opening and closing of a media tray for a media handling device, such as a printer, by interposing a damper between the media tray and a frame of the media handling device. This damper introduces a sliding frictional engagement of the printer tray with the damper to impart a controlled motion during pivotal movement of the media tray relative to the frame.

While specific embodiments have been illustrated and described, herein for purposes of description of the example embodiments, it will be appreciated by those of ordinary skill in the art that a wide variety of alternate and/or equivalent implementations may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A media handling device comprising:

a frame including a pair of first protrusions with each first protrusion disposed on opposite sides of the frame and at least one second protrusion;

a media tray mountable to the frame for pivotal movement between a first position and a second position relative to the frame, and including a finger portion protruding from an end of the media tray, wherein the finger portion is made from a thermoplastic material; and a damper disposed on the frame and including a contact portion shaped for maintaining frictional engagement with the finger portion of the media tray, wherein at least the contact portion of the damper is made from an elastomeric material, wherein the at least one second protrusion is configured for removably mounting the damper on the frame in a position adjacent one of the first protrusions of the frame.

2. The media handling device of claim 1 wherein the media tray comprises a pair of securing holes disposed on opposite sides of the media tray with each of the securing holes configured for pivotal mounting on each of respective first protrusions of the frame to enable the media tray for pivotal movement relative to the frame.

3. The media handling device of claim 1 wherein the damper comprises a slot configured for slidably mounting the damper on the at least one second protrusion of the frame.

4. The media handling device of claim 1 wherein the at least one second protrusion comprises a pair of second protrusions and the damper comprises a pair of dampers, with the second protrusions disposed on opposite sides of the frame adjacent each of the first protrusions and with each of the dampers mounted on the respective second protrusions.

5. A media handling device comprising:

a frame;

a media tray mountable to the frame for pivotal movement between a first position and a second position relative to the frame, and including a finger portion protruding from an end of the media tray, wherein the finger portion is made from a thermoplastic material; and a damper disposed on the frame and including a contact portion shaped for maintaining frictional engagement with the finger portion of the media tray, wherein at least the contact portion of the damper is made from an elastomeric material and the contact portion includes:

a first contact surface configured to maintain the media tray in its second position relative to the frame;

a second contact surface having a concave surface and configured to enable the frictional engagement as sliding movement between the concave surface and the finger portion of the media tray to move the media tray between its first position and the second position; and a third contact surface configured to maintain the media tray in its first position relative to the frame.

6. The media handling device of claim 5 wherein the second contact surface of the damper has a radius of curvature that varies to maintain a substantially uniform velocity of the media tray as its pivots between the first position and the second position; and wherein the first contact surface and the third contact surface of the damper each comprise a flat surface that forms an obtuse angle relative to the second contact surface.

* * * * *